US009242838B2

(12) United States Patent
Benosman

(10) Patent No.: US 9,242,838 B2
(45) Date of Patent: *Jan. 26, 2016

(54) ELEVATOR ROPE SWAY AND DISTURBANCE ESTIMATION

(75) Inventor: Mouhacine Benosman, Boston, MA (US)

(73) Assignee: MITSUBISHI ELECTRIC RESEARCH LABORATORIES, INC., Cambridge, MA (US)

( * ) Notice: Subject to any disclaimer, the term of this patent is extended or adjusted under 35 U.S.C. 154(b) by 695 days.

This patent is subject to a terminal disclaimer.

(21) Appl. No.: 13/613,640

(22) Filed: Sep. 13, 2012

(65) Prior Publication Data

US 2014/0069747 A1 Mar. 13, 2014

(51) Int. Cl.
*B66B 1/34* (2006.01)
*B66B 7/06* (2006.01)

(52) U.S. Cl.
CPC ..... *B66B 7/06* (2013.01)

(58) Field of Classification Search
CPC ..... B66B 7/06
USPC ..... 187/247, 292, 391, 393, 414; 702/141, 702/150
See application file for complete search history.

(56) References Cited

U.S. PATENT DOCUMENTS

| | | | | | |
|---|---|---|---|---|---|
| 4,056,169 | A * | 11/1977 | Showalter | 187/278 |
| 4,460,065 | A | 7/1984 | Saxer | |
| 5,509,503 | A * | 4/1996 | Salmon | 187/266 |
| 5,861,084 | A * | 1/1999 | Barker et al. | 187/264 |
| 5,947,232 | A | 9/1999 | Traktovenko | |
| 7,909,144 | B2 * | 3/2011 | Fukui et al. | 187/393 |
| 2010/0065381 | A1 | 3/2010 | Roberts | |
| 2013/0173206 | A1 * | 7/2013 | Benosman et al. | 702/141 |
| 2013/0275081 | A1 * | 10/2013 | Benosman et al. | 702/150 |
| 2014/0000985 | A1 * | 1/2014 | Fukui et al. | 187/247 |
| 2014/0124300 | A1 * | 5/2014 | Benosman | 187/247 |
| 2014/0229011 | A1 * | 8/2014 | Fukui et al. | 700/275 |
| 2015/0008075 | A1 * | 1/2015 | Benosman et al. | 187/247 |
| 2015/0027814 | A1 * | 1/2015 | Benosman | 187/247 |

FOREIGN PATENT DOCUMENTS

| | | | |
|---|---|---|---|
| JP | 2008133105 | | 6/2008 |
| JP | 20080247504 | A | 10/2008 |
| WO | 2010013597 | A1 | 2/2010 |
| WO | 2013103050 | A1 | 7/2013 |
| WO | 2013153881 | A1 | 10/2013 |

* cited by examiner

*Primary Examiner* — Anthony Salata
(74) *Attorney, Agent, or Firm* — Dirk Brinkman; Gene Vinokur

(57) ABSTRACT

A sway of an elevator rope is determined during an operation of an elevator system. A disturbance of the elevator system is determined based on a state model of the elevator system and at least one measurement of a state of the elevator system. The sway of the elevator rope is determined based on the disturbance and a system model of the elevator system.

16 Claims, 12 Drawing Sheets

100

200

300

500

ELEVATOR ROPE SWAY AND DISTURBANCE ESTIMATION

FIELD OF THE INVENTION

This invention relates generally to elevator systems, and more particularly to measuring a lateral sway of an elevator rope of an elevator system.

BACKGROUND OF THE INVENTION

Typical elevator systems include a car and a counterweight confined to travel along guiderails in, e.g., a vertically extending elevator shaft. The car and the counterweight are connected to each other by hoist ropes. The hoist ropes are wrapped around a sheave located in a machine room at the top (or bottom) of a building or structure. In conventional elevator systems, the sheave is powered by an electrical motor. In other elevator systems, the sheave is unpowered, and the drive means is a linear motor mounted on the counterweight.

Rope sway refers to oscillation of an elevator ropes, e.g., the hoist and/or compensation ropes. The elevator rope can be any type of rope suitable for use in the elevator system, such as cable, chain, or hawser. The oscillation can be a significant problem in a roped elevator system. The oscillation can be caused, for example, by vibration emanating from wind induced building deflection and/or the vibration of the ropes during operation of the elevator system. If the frequency of the vibrations approaches or enters a natural harmonic of the ropes, then the oscillation displacements can increase far greater than the displacements. In such situations, the ropes can tangle with other equipment in the elevator system, or as the elevator travels, come out of the grooves of the sheaves. If the elevator system use multiple ropes and the ropes oscillate out of phase with one another, then the ropes can become tangled with each other and the elevator system may be damaged.

Several conventional solutions use mechanical devices connected to the ropes to estimate the displacement of the ropes. For example, one solution uses a device attached to a compensating rope sheave assembly in an elevator system to detect rope sway exceeding a certain magnitude. However, a mechanical device attached to a compensating rope is difficult to install and maintain.

Another method uses displacement and the natural frequency of the building for estimating and computing the amount of sway of the rope. This method is general and may not provide precise estimation of the rope sway.

Accordingly, there is a need to improve an estimation of a rope sway methods suitable for the estimation of the rope sway in real time.

SUMMARY OF THE INVENTION

Embodiments of the invention are based on a realization that rope sway can be determined based on a model of an elevator system when the disturbance of the elevator system is known. Unfortunately, the disturbance is generally unknown due to, e.g. cost involved in measurement the disturbance. However, some embodiments are based on another realization that a state model of the elevator system can be determined to relate the disturbance of the system, or a model of the disturbance, to a state of the elevator system. Thus, based on the state model and a set of measurements of the state of the elevator system, the disturbance of the elevator system can be determined. Such realizations allow for efficient model-based determination of the disturbance of the elevator system and, subsequently, the sway of the elevator rope, which is suitable for real-time applications.

The measurements of the state of the elevator system can be determined during an operation of the elevator system. The state can be determined based on various types of measurements, e.g., based on measurements of a sway of the rope at sway locations, measurements of tension of the rope, or measurements of vibration of the elevator car.

Some embodiments are based on another realization that if the state of the system is determined using the measurement of the sway of the rope provided by the sway sensors, the measurements of the same sensors can be used to adjust a sway function and to increase the accuracy of the sway determination.

Some embodiments are based on another realization that a number of measurements of the state can be correlated with a number of unknown coefficients in the model of the disturbance. Also, some embodiments are based on another realization that a number of sensors required to determine sufficient number of measurements can be reduced by using the measurements of the same sway sensor at different instants of time.

Accordingly, one embodiment of the invention discloses a method for determining a sway of an elevator rope during an operation of an elevator system. The method includes determining a disturbance of the elevator system based on a state model of the elevator system and at least one measurement of a state of the elevator system; and determining the sway of the elevator rope based on the disturbance and a system model of the elevator system. Steps of the method are performed by a processor.

Another embodiment discloses a method for determining a sway of an elevator rope during an operation of an elevator system, wherein the sway of the elevator rope includes a sway function of amplitudes of the sway along a length of the elevator rope over time. The method includes determining a disturbance of the elevator system based on a state model of the elevator system and a number of measurements of a state of the elevator system, wherein the number of measurements equals a number of unknown coefficients in the model of the disturbance; and determining the sway of the elevator rope based on the disturbance and a system model of the elevator system, wherein the state model relates the unknown coefficients of the disturbance to the amplitudes of the sway, and wherein the system model relates an amplitude of the disturbance to the amplitude of the sway.

The method can also optionally include determining the number of measurements with a number of sensors, wherein the number of sensors is less than the number of measurements; and adjusting the sway based on a difference between the measurement and estimated sway at a time instance and a location of the measurement.

Another embodiment discloses an elevator system including an elevator car; an elevator rope attached to the elevator car; a set of sensors arranged for determining at a set of measurements of a state of the elevator system; and a sway measurement unit for determining a sway of the elevator rope based on the set of measurements. The sway measurement unit includes a memory for storing a state model of the elevator system and a system model of the elevator system, wherein the state model relates coefficients of disturbance of the elevator system to the set of measurements, and wherein the system model relates an amplitude of the disturbance to the amplitude of sway of the elevator rope; and a processor for determining the disturbance of the elevator system based on the state model and the set of measurements, and for determining the sway of the elevator rope based on the disturbance and the system model.

DETAILED DESCRIPTION OF THE PREFERRED EMBODIMENT

Figure 1:
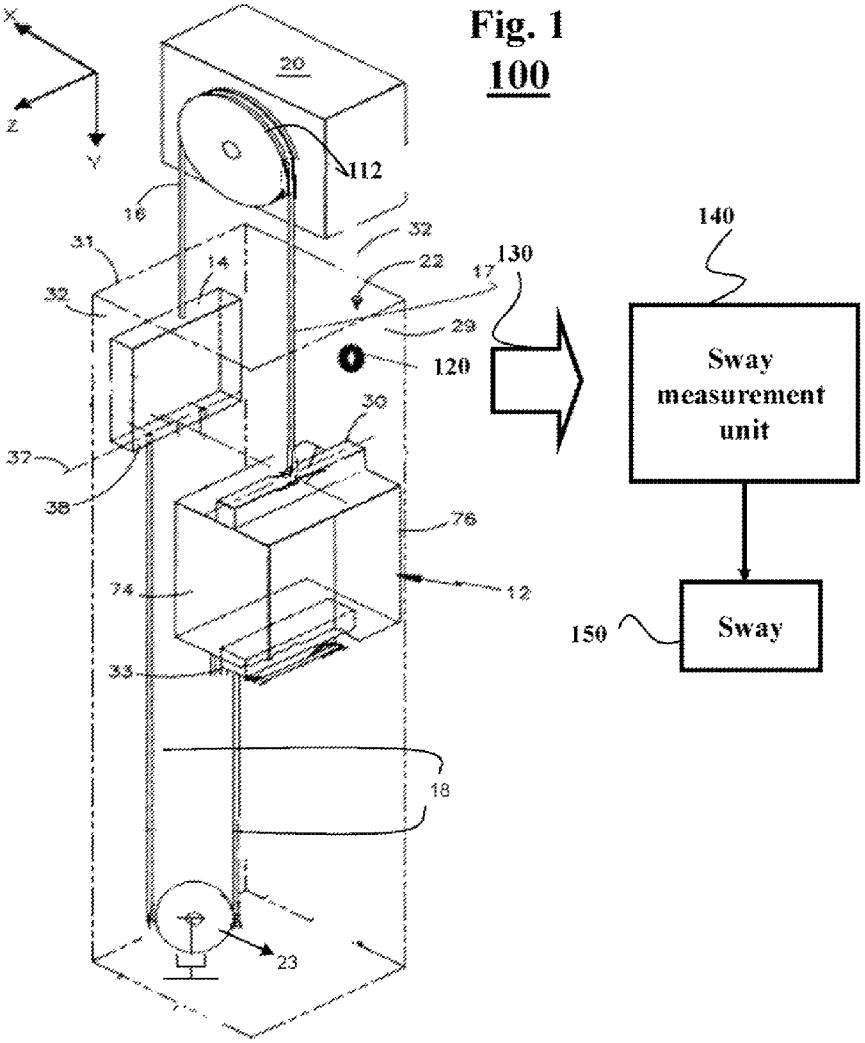
FIG. 1 is an isometric schematic of an example elevator system in which the embodiments of the invention operate.

FIG. 1 shows an example elevator system 100 according to one embodiment of an invention. The elevator system includes an elevator car 12 connected by at least one elevator rope to different components of the elevator system. For example, the elevator car and a counterweight 14 attached to one another by main ropes 16-17, and compensating ropes 18. The elevator car 12 can include a crosshead 30 and a safety plank 33, as known in the art. A pulley 20 for moving the elevator car 12 and the counterweight 14 through an elevator shaft 22 can be located in a machine room (not shown) at the top (or bottom) of the elevator shaft 22. The elevator system can also include a compensating pulley 23. An elevator shaft 22 includes a front wall 29, a back wall 31, and a pair of side walls 32.

The elevator car and the counterweight can have a center of gravity which is defined as a point at which the summations of the moments in the x, y, and z directions about that point equal zero. In other words, the car 12 or counterweight 14 can theoretically be supported at the point of the center of gravity (x, y, z), and be balanced, because all of the moments surrounding this point are cancel out. The main ropes 16-17 typically are attached to the crosshead 30 of the elevator car 12 at a point where the coordinates of the center of gravity of the car are projected. The main ropes 16-17 are similarly attached to the top of the counterweight 14 at a point where the coordinates of the center of gravity of the counterweight 14 are projected.

During the operation of the elevator system, different components of the system are subjected to internal and external disturbance, e.g., a force of wind, resulting in lateral motion of the components. Such lateral motion of the components can result in a sway of the elevator rope that needs to be measured. Accordingly, a set of sensors can be arranged in the elevator system to determine a lateral sway of the elevator rope.

In various embodiments, different types of sensors can be arranged in different positions to determine measurements of a state of the elevator system, such that the sway of the elevator rope can be properly sensed and/or measured. The actual positions of the sensors can depend on the type of the sensors used. For example, the sensors can include a sway sensor 120 configured to sense a lateral sway of the elevator rope at a sway location associated with a position of the sway sensor. The sway sensor 120 can be any motion sensor, e.g., a light beam sensor.

During the operation of the elevator, at least one measurement of the state of the elevator system is determined and transmitted 130 to a sway measurement unit 140. The sway measurement unit determines the sway 150 of the elevator rope by, e.g., using the measurements and various models of the elevator system. Various embodiments use different models. For example, some embodiments use the state model of the elevator system that relates unknown coefficients of the disturbance to amplitudes of sways of the elevator rope. Some embodiments also use a system model of the elevator system that relates amplitude of the disturbance to the amplitude of the sway. Also, in some embodiments, the state model is based on an inverse of the system model, as described in more details below.

Sway Estimation

Some embodiments of the invention are based on a realization that rope sway can be determined based on a model of the elevator system if the disturbance of the elevator system is known. Unfortunately, the disturbance of the system is generally unknown due to, e.g. cost involved in measurement the disturbance. However, some embodiments are based on another realization that the disturbance of the system can be determined based on a state model relating the disturbance of the system to the state of the system and that state of the system can be determined based on at least one measurement of the state of the system during the operation of the system. Examples of types of measurements of the state include measurement of a sway at various locations of the elevator rope, measurements of the tension of the elevator rope, and/or measurements of a vibration of the elevator car.

Figure 2:
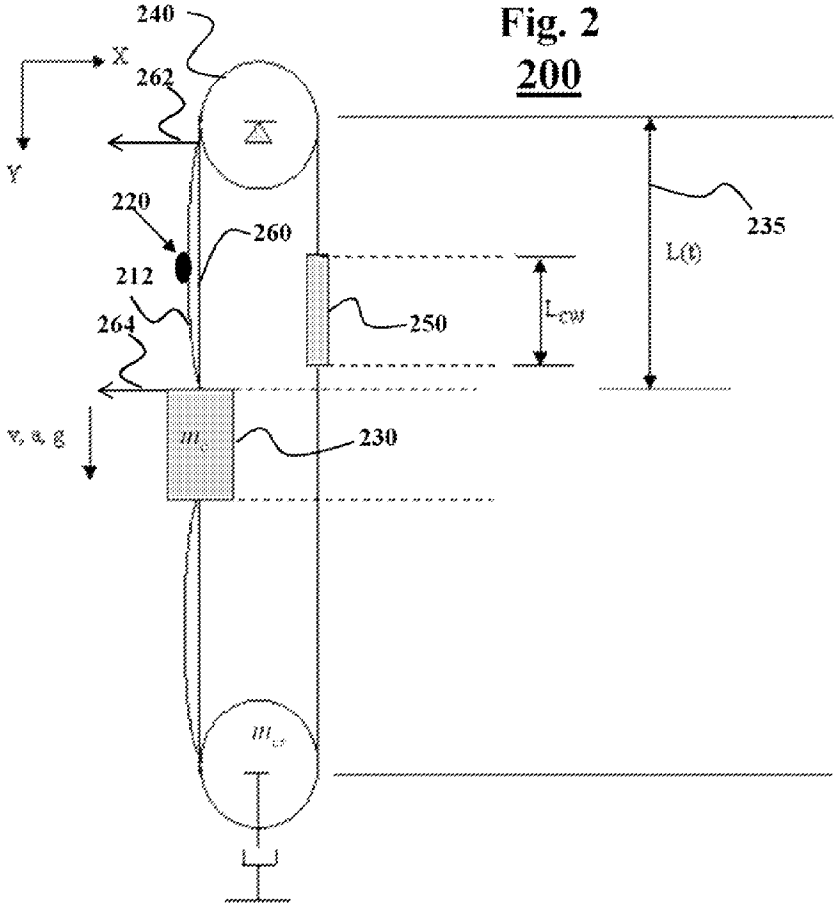
FIG. 2 is a side view schematic of a model of the elevator system according an embodiment of an invention.

FIG. 2 shows an example of a system model 200 of the elevator system 100. The model 200 is based on parameters of the elevator systems. Various systems known in the art can be used to simulate operation of the elevator system according to the model of the elevator system to simulate an actual sway 212 of the elevator rope caused by the operation.

One embodiment performs the modeling based on Newton's second law. For example, the elevator rope is modeled as a string, and the elevator car and the counterweight are modeled as rigid body 230 and 250, respectively. The model of the elevator system is determined by a partial differential equation according to $$\rho\left(\frac{\partial^2}{\partial t^2} + v^2(t)\frac{\partial^2}{\partial y^2} + 2v(t)\frac{\partial}{\partial y \partial t} + a\frac{\partial}{\partial y}\right)u(y, t) - \frac{\partial}{\partial y}T(y)\frac{\partial u(y, t)}{\partial y} + c(y)\left(\frac{\partial}{\partial t} + v(t)\frac{\partial}{\partial y}\right)u(y, t) = 0, \quad (1)$$

wherein $$\frac{\partial^i}{\partial V^i}(s(V))$$

is a derivative of order i of a function s(.) with respect to the variable V, t is time, y is a vertical coordinate, e.g., in an inertial frame, u is a lateral displacement of the rope along the x axes, ρ is the mass of the rope per unit length, T is the tension in the elevator rope which changes depending on a type of the elevator rope, i.e. main rope, compensation rope, c is a damping coefficient of the elevator rope per unit length, v is the elevator/rope velocity, α is the elevator/rope acceleration.

Under the two boundary conditions $$u(0,t)=f_1(t)$$

$$u(l(t),t)=f_2(t), \text{ and}$$

$f_1(t)$ is the first boundary condition representing the top building sway due to external disturbances, e.g. wind conditions, $f_2(t)$ is the second boundary condition representing the car sway due to external disturbances, e.g. wind conditions, l(t) is the length of the elevator rope 17 between the main sheave 112 and the elevator car 12.

For example, a tension of the elevator rope can be determined according to $$T=(m_e+\rho(L(t)-y))(g-\alpha(t))+0.5m_{cs}g$$

wherein $m_e$, $m_{cs}$ are the mass of the elevator car and the pulley 240 respectively, and g is the gravity acceleration, i.e., g=9.8 m/s$^2$.

In one embodiment, the partial differential Equation (1) is discretized to obtain the model based on ordinary differential equation (ODE) according to $$M\ddot{q}+(C+G)\dot{q}+(K+H)q=F(t), \tag{2}$$

wherein q=[q1, . . . , qN] is a Lagrangian coordinate vector, $\dot{q}$, $\ddot{q}$ are the first and second derivatives of the Lagrangian coordinate vector with respect to time. N is a number of vibration modes. The Lagrangian variable vector q defines the lateral displacement u(y, t) by $$u(y,t)=\sum_{j=1}^{j=N} q_j(t)\psi_j(y,t)+\frac{l-y}{l}f_1(t)+\frac{y}{l}f_2(t)$$

$$\psi_j(y,t)=\frac{\phi_j(\xi)}{\sqrt{l(t)}}$$

wherein $\phi_j(\xi)$ is a $j^{th}$ sway function of the dimensionless variable ξ=y/l.

In Equation (2), M is an inertial matrix, (C+G) constructed by combining a centrifugal matrix and a Coriolis matrix, (K+H) is a stiffness matrix and F(t) is a vector of external forces. The elements of these matrices and vector are given by:

$$M_{ij}=\rho\delta_{ij}$$

$$K_{ij}=\frac{1}{4}\rho l^{-2}\dot{l}^2\delta_{ij}-\rho l^{-2}\dot{l}^2\int_0^1(1-\xi)^2\phi_i'(\xi)\phi_j'(\xi)d\xi+\rho l^{-1}(g+\ddot{l})\int_0^1(1-\xi)\phi_i'(\xi)\phi_j'(\xi)d\xi+$$

-continued $$m_e l^{-2}(g+\ddot{l})\int_0^1\phi_i'(\xi)\phi_j'(\xi)d\xi+\frac{1}{2}M_{cs}gl^{-2}\int_0^1\phi_i'(\xi)\phi_j'(\xi)d\xi$$

$$H_{ij}=\rho(l^{-2}\dot{l}^2-l^{-1}\ddot{l})\left(\frac{1}{2}\delta_{ij}-\int_0^1(1-\xi)\phi_i(\xi)\phi_j'(\xi)d\xi\right)-c_p\dot{l}l^{-1}\left(\int_0^1\phi_i(\xi)\phi_j'(\xi)d\xi+0.5\delta_{ij}\right)$$

$$G_{ij}=\rho l^{-1}\dot{l}\left(2\int_0^1(1-\xi)\phi_i(\xi)\phi_j'(\xi)d\xi-\delta_{ij}\right)$$

$$C_{ij}=c_p\delta_{ij}$$

$$F_i(t)=-l\sqrt{l}(\rho s_1(t)+c_p s_4(t))\int_0^1\phi_i(\xi)\xi d\xi+\sqrt{l}(s_5(t)-\rho f_1^{(2)}(t))\int_0^1\phi_i(\xi)d\xi$$

$$s_5(t)=-2v\rho s_2(t)-g(t)s_3(t)-c_p f_1^{(2)}(t)$$

$$s_1(t)=\frac{l\ddot{l}-2\dot{l}^2}{l^3}f_1(t)+\frac{\dot{l}}{l^2}\dot{f}_1(t)+\frac{\dot{l}}{l^2}\dot{f}_1(t)+\frac{1}{l^4}(l^3 f_2^{(2)}(t)-f_2(t)l^2 l^{(2)}+2l\dot{l}^2 f_2(t)-2l^2\dot{l}\dot{f}_2(t))-\frac{\ddot{f}_1(t)}{l}$$

$$s_2(t)=\frac{\dot{l}}{l^2}f_1(t)-\frac{\dot{f}_1}{l}+\frac{\dot{f}_2}{l}-f_2\frac{\dot{l}}{l^2}$$

$$s_3(t)=\frac{f_2(t)-f_1(t)}{l}$$

$$s_4(t)=\frac{\dot{l}}{l^2}f_1(t)-\frac{\dot{f}_1}{l}+\frac{\dot{f}_2\dot{l}-f_2\dot{l}}{l^2}$$

$$\phi_i(\xi)=\sqrt{2}\sin(\pi i\xi),\ \delta_{ij} \text{ (kronecker delta)}$$

wherein $\dot{S}$(.) is a first derivative of a function s with respect to its variable, the notation $s^{(2)}$(.) is a second derivative of the function s with respect to its variable, and $$\int_{v0}^{vf}s(v)dv$$

is an integral of the function s with respect to its variable v over the interval [$v_0$, $v_f$]. The Kronecker delta is a function of two variables, which is 1 if the variables are equal and 0 otherwise.

The system models given by Equation (1) and Equation (2) are two examples of the system models of the elevator system that relate amplitude of the disturbance to the amplitude of the sway. Other models based on a different theory, e.g., a beam theory, instead of a string theory, can be used by the embodiments of the invention.

Also, in various embodiments the state model of the system includes a model of the disturbance of the system having unknown coefficients. Such formulation allows relating the unknown coefficients of the disturbance to the measurements of the state. In some embodiments, such relation is based on an inverse of the system model described above. For example, in some embodiments, the disturbance of the elevator system is modeled as a sinusoidal top sway of the building, which can be modeled by the boundary input signal f1(t). The boundary input signal can be sinusoidal with unknown coefficients including one or combination of amplitude, frequency and phase of the signal. In some embodiments, the boundary input signal is modeled as a set of sinusoidal signals, each sinusoidal signal includes its unknown coefficients including one or combination of amplitude, frequency and phase.

For example, one embodiment relates a first 262 and a second 264 boundary conditions according to $$f_2(t) = f_1(t)\sin\left(\frac{\pi(H-y)}{2H}\right),\ y \in [1, H]$$

wherein H is a length of the elevator rope. Then, the system model is inversed to determine a mapping between the unknown coefficients of the disturbance to the measurements of the state of the elevator system, e.g., the amplitudes of the sway. Examples of the mapping are described below.

Figure 3A:
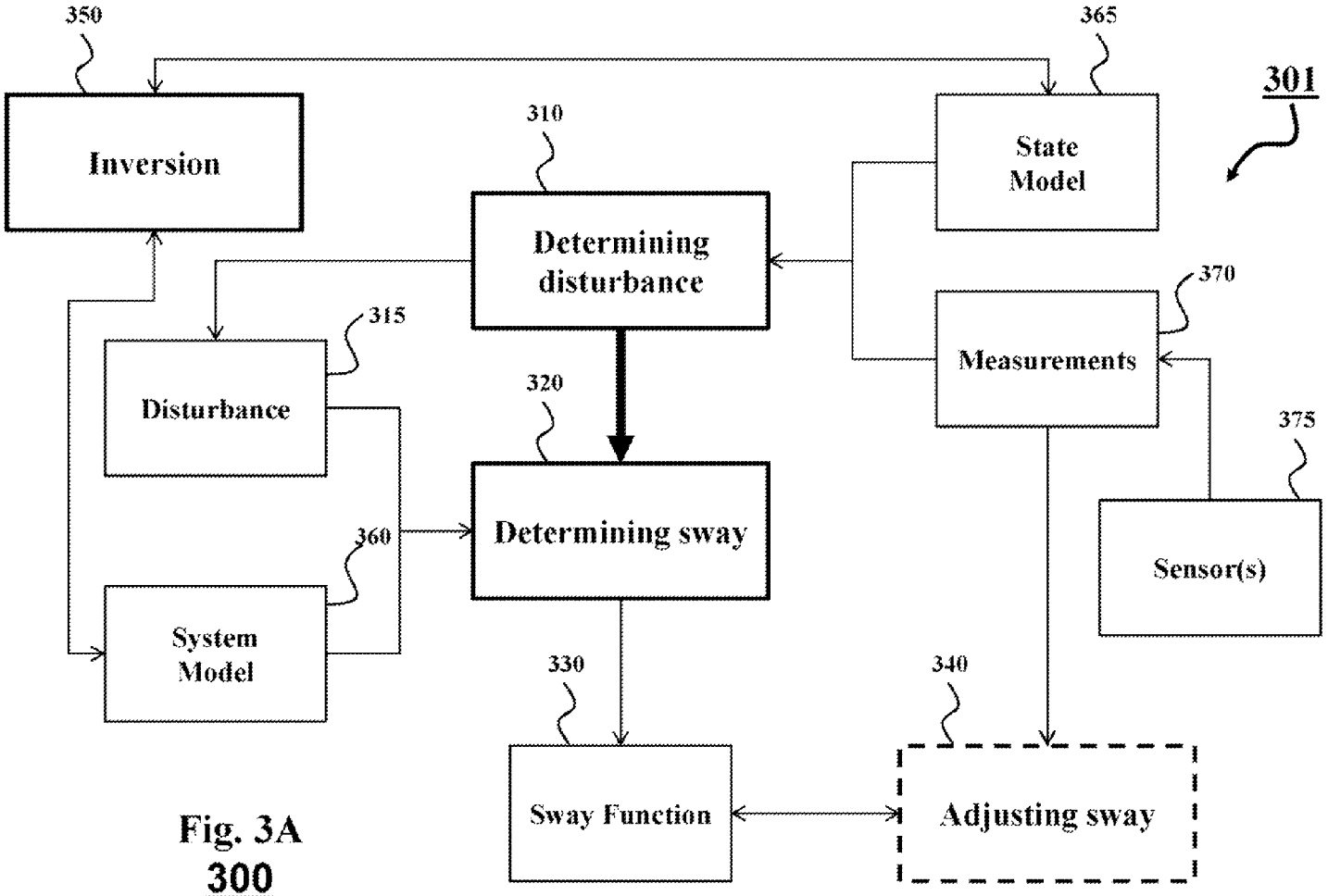
FIG. 3A is a block diagram of a method for determining a sway of an elevator rope during an operation of an elevator system according an embodiment of an invention.

FIG. 3 shows a block diagram of a system and a method 300 for determining a sway of an elevator rope during an operation of an elevator system. The system and the method can be implemented, at least in part, using a processor 301. First, a disturbance 315 of the elevator system is determined 310 based on a state model 365 of a state of the elevator system and a number of measurements 370 of the state of the elevator system. In some embodiments, the number of measurements equals a number of unknown coefficients in the model of the disturbance.

For example, if the model of the disturbance includes three unknown coefficients, e.g., amplitude, frequency and phase of the sinusoidal signal, then the number of measurements include three non-zero measurement, e.g., as measured by sensors 375. In some embodiments, the phase of the sinusoidal signal is not used, and the number of measurements is reduced to two non-zero measurements. In another embodiment, the model of disturbance includes multiple sinusoidal signals, and the number of measurements is adjusted accordingly. Other variations are possible.

Next, based on the disturbance 315 and a system model 360 of the elevator system, the sway of the elevator rope connecting an elevator car and a pulley is determined 320. In some embodiments, the sway of the elevator rope includes a sway function 330 of amplitudes of sways along a length of the elevator rope over time. As described above, the state model relates the unknown coefficients of the disturbance to the amplitudes of sways. The system model relates amplitude of the disturbance to the amplitude of the sway. Example of the system model includes the model 200.

In some embodiments, the state model 365 is based on an inverse 350 of the system model 360. For example, the model of the elevator system is inverted 350 to determine an estimate of the building disturbance 315, e.g. wind amplitude and frequency acting on the top of the building. The building disturbance estimate is used together with direct system model 360 of the elevator system to determine an estimate of the elevator rope sway 330. In various embodiments, the state and the system models are stored in a memory operatively connected to the processor 301.

Some embodiments of the invention are also based on a realization that it can be advantageous to adjust 340 the sway function based on the measurements of the state of the system. As discussed above, the measurements of the state can be measured using various types of the sensors 375. However, one embodiment of the invention uses sway sensors arranged at the sway location for measuring the state. This embodiment is advantageous for some applications, because the measurements of the same sensors can be used or reused for adjusting the sway.

Figure 3B:
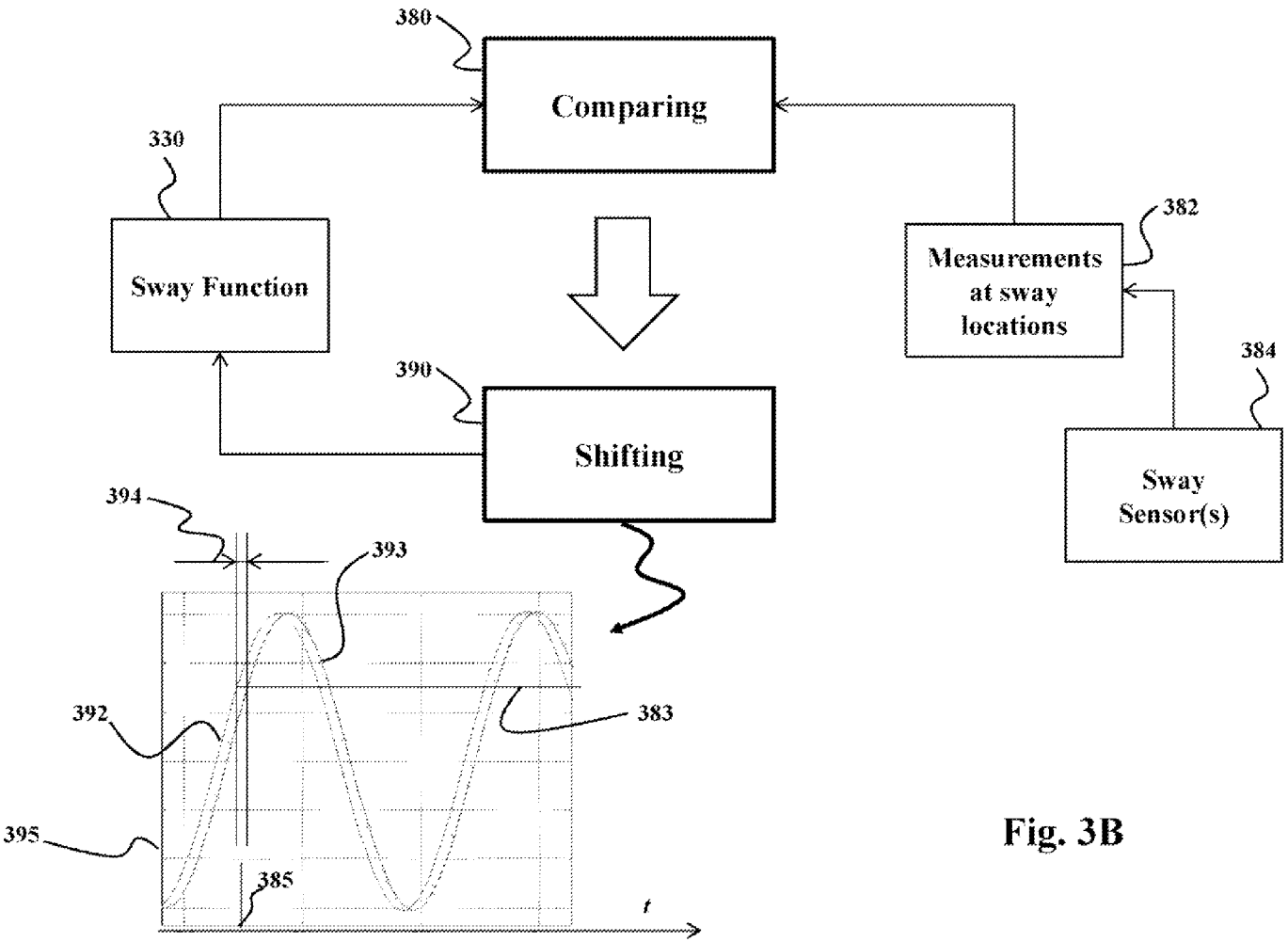
FIG. 3B is a block diagram of a method for adjusting the sway function based on the measurement according an embodiment of an invention.

FIG. 3B shows an example of such embodiment for adjusting the sway function. This embodiment compares 380 the measurement 382 of the sway sensors 384 at a time instant and a sway location 383 and estimated sway of the sway function 330 for the same time instance and the sway location. A graph 395 shows an estimated 392 and an actual 393 sways, and the difference 394 between the sways 392 and 393 at the location 383 and the time instant 385. Hence, some embodiments shift 390 the sway function 330 based on the difference 394.

In various embodiments, the sway sensor is placed in an elevator shaft of the elevator system, such as the system 100, to sense a lateral sway of the elevator rope at the sway location. The arrangement of one or a combination of sway sensors differs among embodiments. For example, in one embodiment, the sway sensors are arranged horizontally, i.e. perpendicular to the elevator shaft. In another embodiment only one sway sensor is used. In another embodiment, arbitrarily arrangement of the sensor is used. However, some other embodiments use different type of sensors. For example, one embodiment uses a set of rope tension sensors is placed along the rope to sense the rope tension at various locations.

Figure 4A:
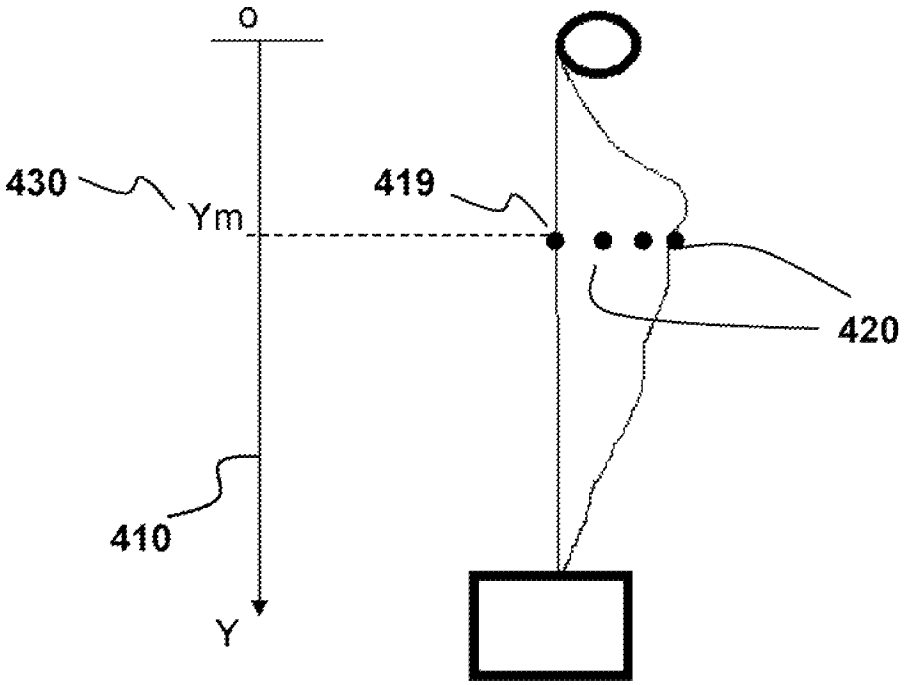
FIG. 4A is a schematic of a horizontal placement of four sway sensors within the elevator shaft according an embodiment of an invention.

FIG. 4A shows a placement of the sway sensors in the elevator shaft according to one embodiment. In this embodiment, four sway sensors 420 are placed horizontally at the position Ym 430 along the vertical axis [0 Y) 410. The four sway sensors produce four different sway measurements at four different instants. These four sway measurements are then used to compute the system and the state models.

In this embodiment, four sway measurements can be used as follows. The first sway measurement is used to initialize the time reference, i.e. time reference is set to zero when the rope moves from the vertical sway-free position and the first sway sensor 419 is triggered. Then, the remaining three sway sensors provide three different sway measurements at three different time instants. These three measurements are used to determine, using the state model, the unknown coefficients of the disturbance, i.e. the disturbance amplitude, the disturbance frequency, and the disturbance phase. Based on these three coefficients the building disturbance can be estimated at any time instant. Next, the building disturbances estimate is used to simulate the elevator system using the system model to determine the sway elevator rope.

Figure 4B:
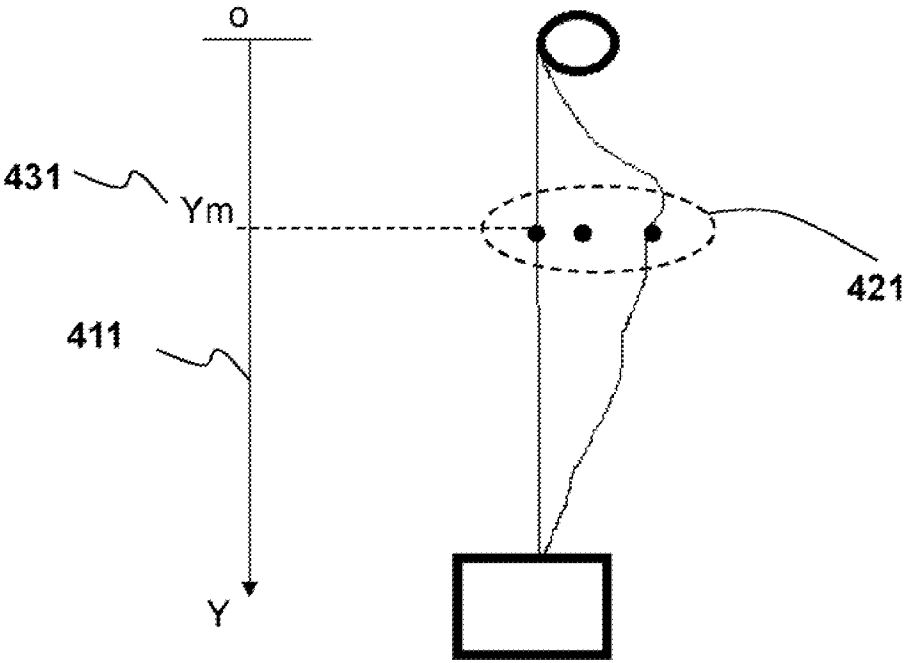
FIG. 4B is a schematic of a horizontal placement of three sway sensors within the elevator shaft according an embodiment of an invention.

In the of FIG. 4B, only three sway sensors 421 are used to determine two coefficients of the disturbance, i.e. amplitude and frequency. In this embodiment, the value of the phase is negligible.

Figure 4C:
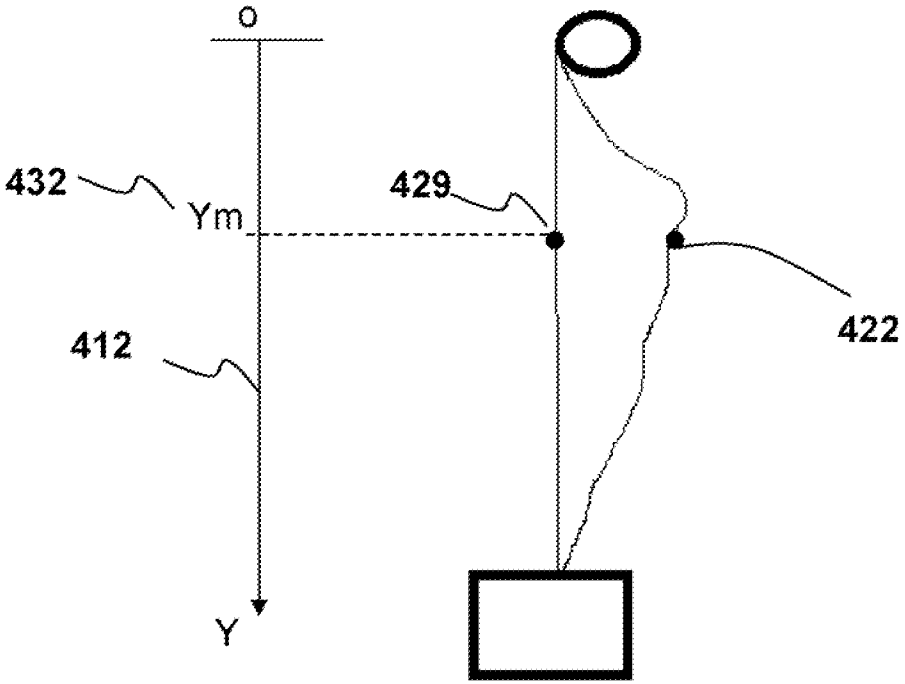
FIG. 4C is a schematic of a horizontal placement of two sway sensors within the elevator shaft according an embodiment of an invention.

In another embodiment of FIG. 4C, only two sway sensors 429 and 422 are used to determine the coefficients of the building disturbances. In this embodiment, the first sway sensor 429 is used to fix the time reference and then the second sensor 422 is used to collect several sway measurements when the rope crosses the sensor 422 over several time instants. These several sway measurements are then used to determine several unknown coefficients of the building disturbances.

Figure 4D:
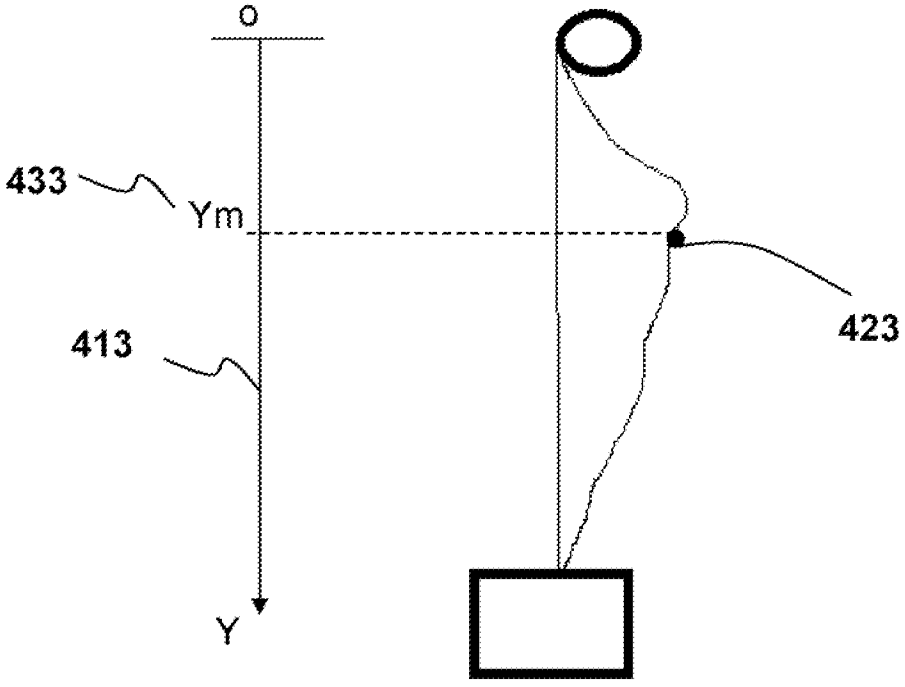
FIG. 4D is a schematic of a horizontal placement of one sway sensor within the elevator shaft according an embodiment of an invention.

For example, to determine two coefficients of the building disturbances, two sway measurements of the sensor 422 collected at two different time instants are used. Similarly, to determine N (N is positive integer) coefficients of the building disturbances, e.g. the disturbance is a superposition of many sinusoidal functions with several amplitudes, frequencies and phases, N sway measurements of the sensor 422 is used at N different time instants In another embodiment of FIG. 4D, only one sway sensor 423 is sued to determine N sway measurements to estimate N coefficients of the disturbance.

Figure 4E:
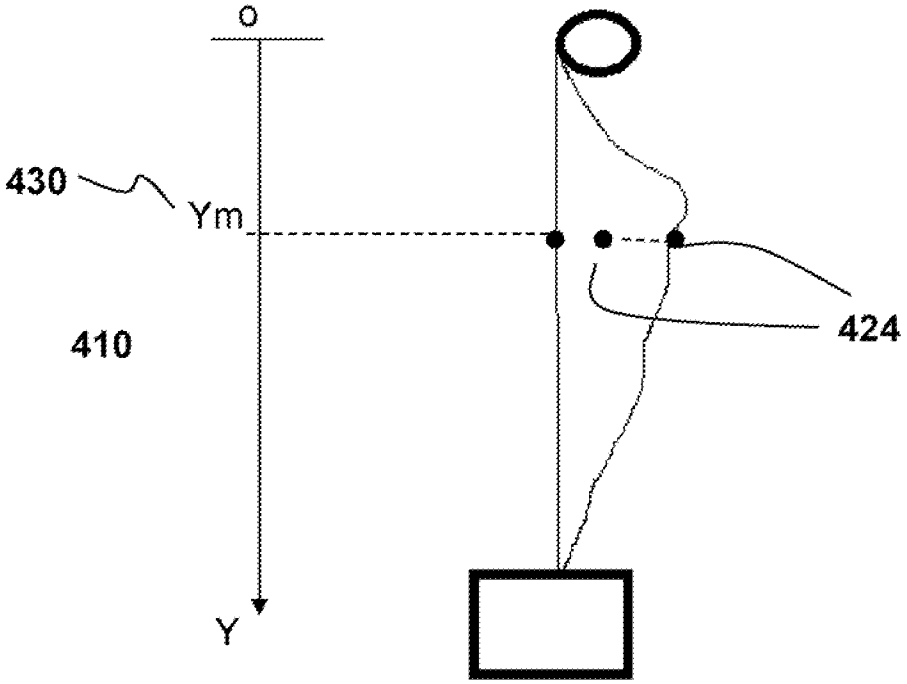
FIG. 4E is block diagram of a method for horizontal placement of the sensors within the elevator shaft.

In another embodiment of FIG. 4E, N sway sensors 424 are arranged horizontally at the position Ym 430 in the elevator shaft to determine N different sway measurements to estimate N coefficients of the building disturbance.

Figure 5:
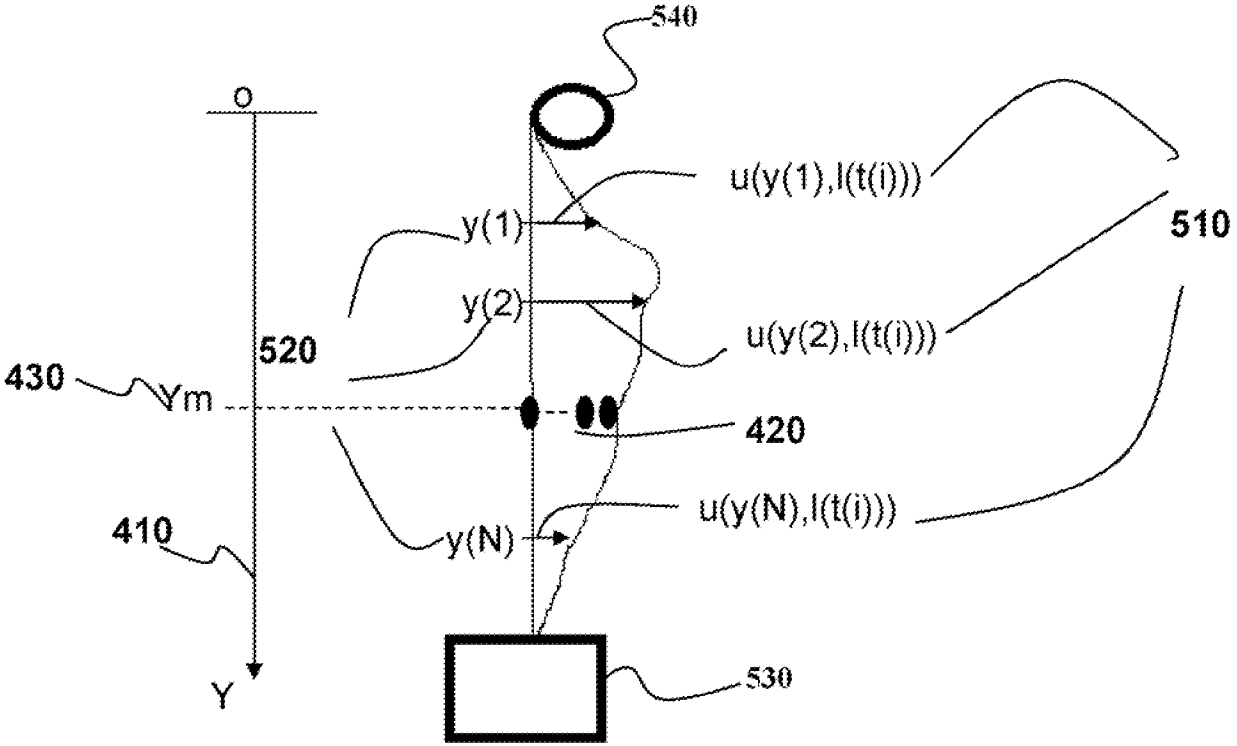
FIG. 5 is a schematic of one embodiment of the invention using measurements of at least one sway sensors.

FIG. 5 shows a schematic of one embodiment of the invention using measurements of at least one sway sensors. The at least one measurement of the state includes amplitudes of the sway of the elevator rope at the time instant t(i). Then, the disturbance is determined based on the state model and the amplitudes 510, and the sway function is determined based on the disturbance and the system model. The sway function is adjusted at each time the rope crosses the sway sensor(s) 420.

For example, the sway of the elevator rope is estimated at the time instants t(i) according to $$u(y,t(i))510, \text{ for all } y\epsilon[0,l(t(i))]520,$$

wherein y is a vertical coordinate 410 in an inertial frame, u is a lateral displacement of the rope along the x axes, l is the length of the elevator rope between two boundary locations.

Figure 6:
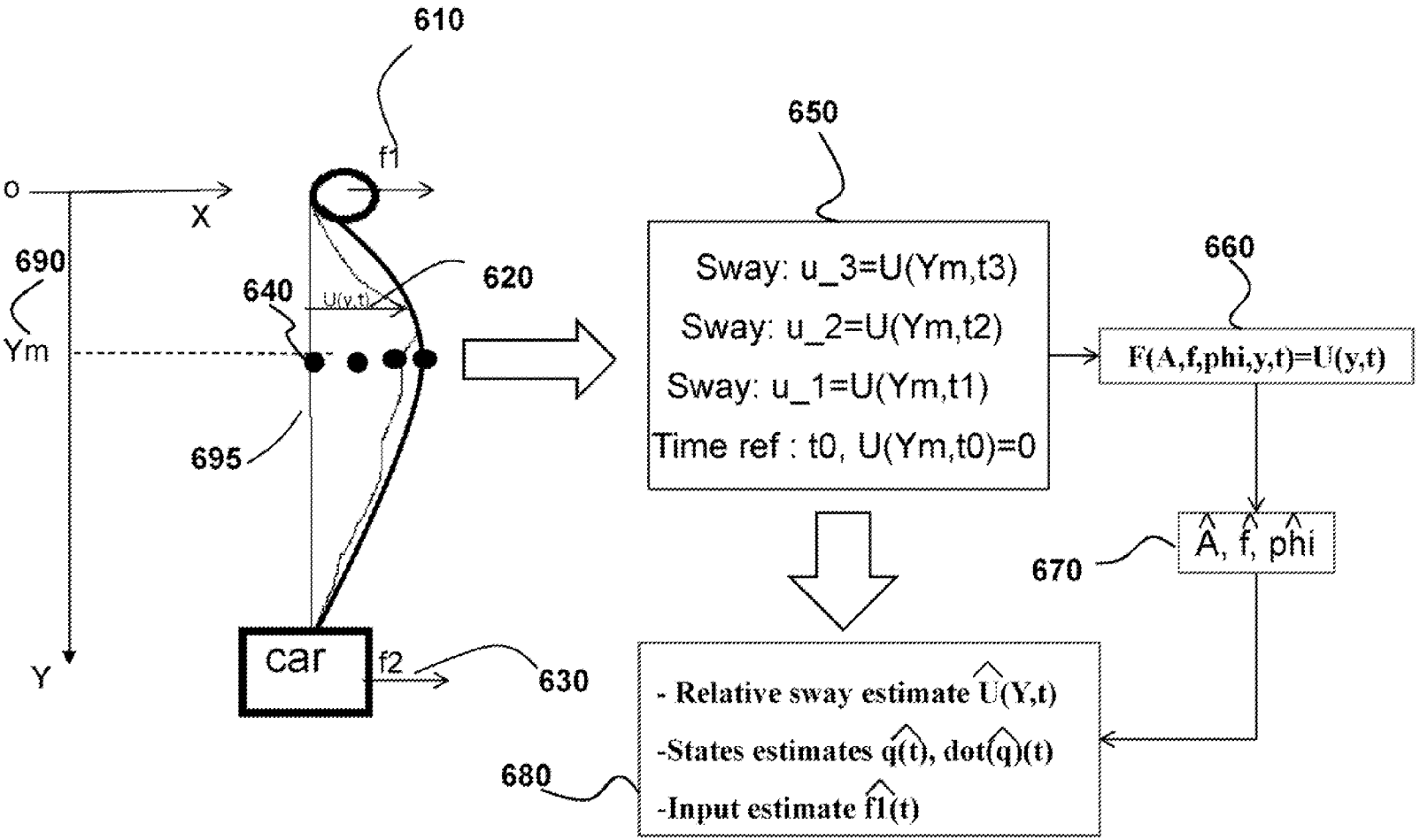
FIGS. 6 and 7 are schematic of exemplar embodiments of the invention.

FIG. 6 shows a schematic of another embodiment that considers a sinusoidal sway due to external disturbance, which is modeled based on a first 610 and a second 630 boundary conditions related by $$f_2(t) = f_1(t)\sin\left(\frac{\pi(H-y)}{2H}\right),\ y \in [1, H].$$

In this embodiment, the system model is used to determine a relationship 660 F between the unknown coefficients of the disturbance and the amplitude of the sway. For example in one embodiment, the system model in equation (2) is considered, where a sinusoidal disturbance f1(t) of the elevator system is $$f_1(t)=A\sin(2\pi ft+\phi)$$

wherein A is the amplitude of the disturbance, f is the frequency of the disturbance, $\phi$ is the phase of the disturbance, t is time.

The sinusoidal disturbance and the relationship relating f2(t) to f1(t) can be used to formulate lateral sway displacement equation, e.g., $$u(y, t) = \sum_{j=1}^{j=N} q_j(t)\psi_j(y, t) + \frac{l-y}{l} f_1(t) + \frac{y}{l} f_2(t)$$

$$\psi_j(y, t) = \frac{\phi_j(\xi)}{\sqrt{l(t)}}$$

The relationship between the unknown coefficients of the disturbance and the amplitude of the sway can be written according to $$F(A,f,\phi,y,t)=U(y,t),$$

wherein A is the amplitude of the disturbance, f is the frequency of the disturbance, $\phi$ is the phase of the disturbance, y is a position along the vertical axe [0 Y) of the elevator shaft, t is time, and U(y, t) is the sway 620. After estimation 670 of the coefficients of the disturbance is determined (note that we denote by $\hat{a}$ the estimate of the variable $\alpha$), the estimation of the boundary input signal $f_1(t)$ and the rope sway for all time instant noted U(y, t) are determined 680 as well.

In one embodiment, the sway sensors are located at the vertical position $Y_m$ 690 in the elevator shaft. The first sway sensor 640 is placed at the neutral line 695, where the sway measurement is zero. This sensor is used to detect when the rope first start swaying and then set a time counter to. After to is set the second sensor when triggered gives the first non-zero sway measurement $u_1=U(Y_m, t_1)$ detected at time instant $t_1$. Next the third sway sensor when triggered give the second non-zero sway measurement $u_2=U(Y_m, t_2)$ detected at time instant $t_2$. Next the fourth sway sensor when triggered give the second non-zero sway measurement $u_3=U(Y_m, t_3)$ detected at time instant $t_3$.

After determining three non-zero sway measurement $u_1$, $u_2$ and $u_3$, the following system of three algebraic equations with three unknown variables A, f, $\phi$ can be solved $$\text{a. } F(A,f,\phi,y_m,t_1)=U(Y_m,t_1)=u_1,$$

$$\text{b. } F(A,f,\phi,y_m,t_2)=U(Y_m,t_2)=u_2,$$

$$\text{c. } F(A,f,\phi,y_m,t_3)=U(Y_m,t_3)=u_3. \quad (3)$$

This mapping between the variables A, f, $\phi$ and the three rope sway measurements $u_1$, $u_2$ and $u_3$ is inverted 660 to obtain the estimate of the variables A, f, $\phi$. The Equation (3) is solved using for example a Newton-Raphson method to solve the algebraic nonlinear equations. Next, using the system model given by, e.g., Equation (2), and the estimate of the coefficients of the disturbance, an estimate of rope sway U(Y, t), and estimate of the states q(t), dot(q)(t) for all time instant t and all vertical position Y along the elevator shaft can be determined.

Figure 7:
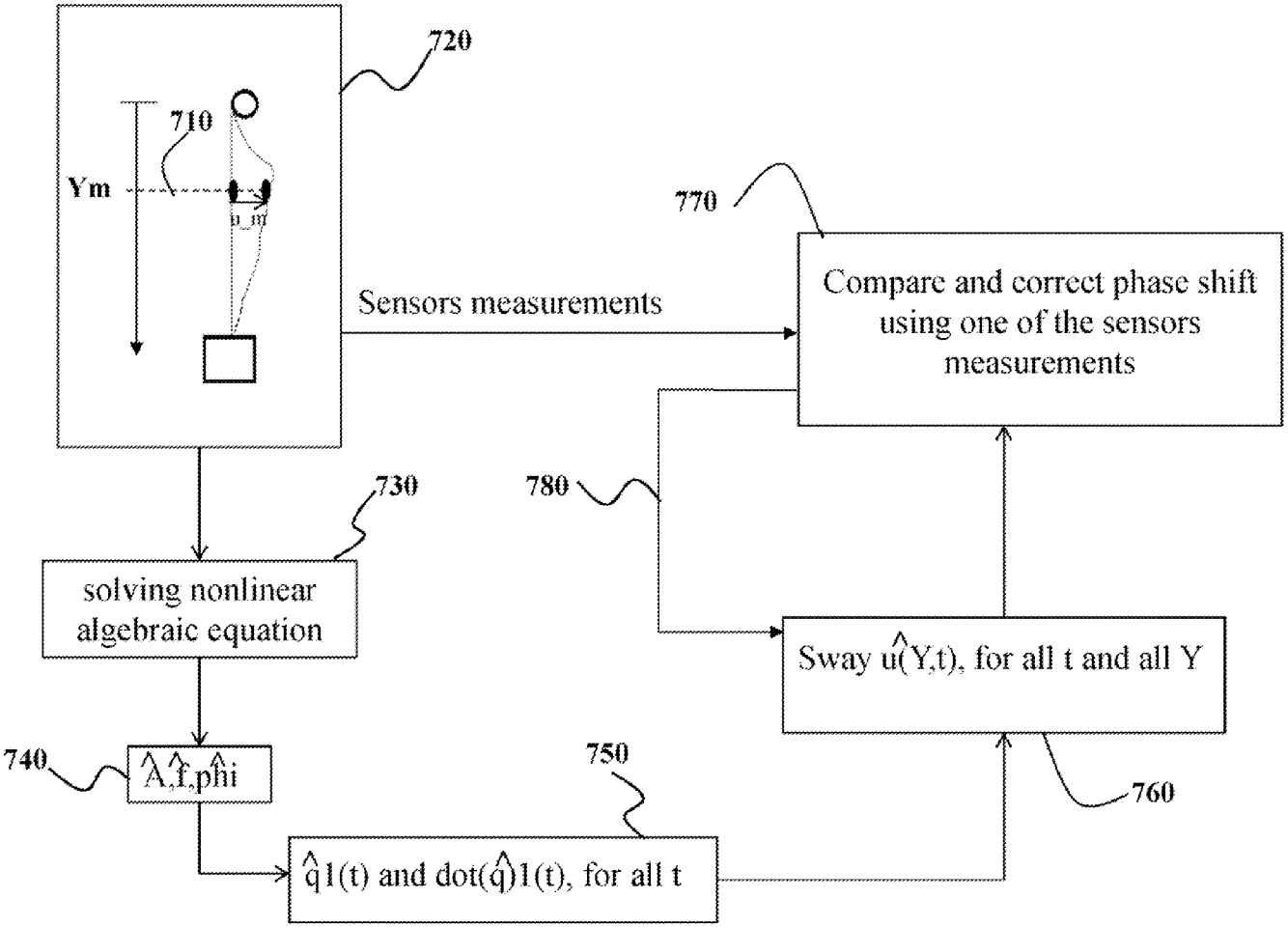

FIG. 7 shows a schematic of another embodiment that uses a number of sensors that is less than a number of measurements of the state of the system required to determine the disturbance. This embodiment can be advantageous for applications where the reduction of the number of sway sensors is beneficial.

In this embodiment, the sway sensors can be, e.g., arranged at a vertical position Ym 710 in the elevator shaft. For example, if two sensors are used, one sensor can be placed at the neutral line and the other positioned at a distance $u_m$ from the neutral line. A single sensor positioned at distance from the neutral line can also be used.

The sensors are used to determined, e.g., four sway measurements. For example, if two sensors are used, the first measurement is obtained when the first sway sensor detects that the rope moved from the neutral line and this measurement sets the time reference $t_0=0$. After we collect the next sway measurement from the second sway sensor place at $u_m$ this measurement happens when the second sway sensor is triggered by the rope at the instant $t_1$, i.e., $U(Y_m,t_1)=u_m$. Next, the rope comes back to trigger the second sensor again at the time instant $t_2$, i.e., $U(Y_m,t_2)=u_m$. Next, the rope can trigger the second sensor again at the time instant $t_3$, i.e., $U(Y_m,t_3)u_m$. After necessary number, e.g., three non-zero sway measurements, is determined, the following system of algebraic equations can be used to determine three unknown coefficients A, f, $\phi$ $$\text{a. } F(A,f,\phi,y_m,t_1)=U(Y_m,t_1)=u_m,$$

$$\text{b. } F(A,f,\phi,y_m,t_2)=U(Y_m,t_2)=u_m,$$

$$\text{c. } F(A,f,\phi,y_m,t_3)=U(Y_m,t_3)u_m. \quad (4)$$

This mapping between the coefficients A, f, $\phi$ and the three rope sway measurements represented by Equation (4) is inverted 730 to solve the algebraic system and to determine the estimate of coefficients of the disturbance 740. Using the elevator system model given by equation (2) the disturbance, the embodiments determines an estimate of rope sway U(Y,t) 760, and estimate of the states q(t), dot(q)(t) 750 for all time instant t and all vertical position Y along the elevator shaft.

This embodiment can also adjust the estimated sway to compensate 770 for errors, e.g., in the phase estimation $\phi$ and in the frequency estimation f. To compensate for these errors we introduce a phase correction step 770. For example, in one embodiment, the method of phase correction 780 is to record the time $t_2$ when the rope sway crosses the second sway sensor placed at the distance $u_m$ from the neutral line and compare this time to the time where the rope sway estimation crosses the same sway value $u_m$. Then correct the time $t_e$ of the rope sway function is adjusted 770, e.g., by shifting the sway function to correct for the phase difference Δ between the rope sway estimate and the actual rope sway according to $t_e=t_e\Delta_t$, wherein $\Delta_t=t_2-t_1$.

The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Further, it should be appreciated that a computer may be embodied in any of a number of forms, such as a rack-mounted computer, a desktop computer, a laptop computer, minicomputer, or a tablet computer. Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. For example, some embodiments of the invention use MATLAB-SIMULIMK.

In this respect, the invention may be embodied as a computer readable storage medium or multiple computer readable media, e.g., a computer memory, compact discs (CD), optical discs, digital video disks (DVD), magnetic tapes, and flash memories. Alternatively or additionally, the invention may be embodied as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various aspects of the present invention as discussed above.

Computer-executable instructions may be in many forms, such as program modules, executed by one or more computers or other devices. Generally, program modules include routines, programs, objects, components, and data structures that perform particular tasks or implement particular abstract data types. Typically the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

The invention claimed is:

1. A method for determining a sway of an elevator rope during an operation of an elevator system, comprising:

determining a disturbance of the elevator system based on a state model of the elevator system and at least one measurement of a state of the elevator system;

determining the sway of the elevator rope based on the disturbance and a system model of the elevator system; and preventing the sway to cause damage to the elevator system, wherein steps of the method are performed by a processor.

2. The method of claim 1, wherein the at least one measurement includes a measurement of the sway of the elevator rope.

3. The method of claim 1, wherein the sway of the elevator rope includes a sway function of amplitudes of the sway along a length of the elevator rope over time, further comprising:

adjusting the sway function based on the measurement.

4. The method of claim 3, wherein the adjusting comprising:

shifting the sway function based on a difference between the measurement and estimated sway at a time and a location of the measurement.

5. The method of claim 1, wherein the state model includes a model of the disturbance, and further comprising:

correlating a number of measurements with a number of unknown coefficients in the model of the disturbance;

measuring the number of measurements; and determining the unknown coefficients of the disturbance by solving a system of equations derived from the state model.

6. The method of claim 1, wherein the state model includes a model of disturbance, and wherein the model of disturbance include a combination of one or multiple sinusoidal functions with unknown coefficients.

7. The method of claim 1, wherein the state model is based on an inverse of the system model.

8. The method of claim 5, further comprising:

determining the number of measurement using a set of sway sensors.

9. The method of claim 8, wherein a number of sway sensors in the set is less than the number of the unknown coefficients in the model of the disturbance.

10. The method of claim 9, wherein the sway sensors are arranged at sway locations, further comprising:

adjusting the sway function based on measurements of the sway sensors at the sway locations.

11. A method for determining a sway of an elevator rope during an operation of an elevator system, wherein the sway of the elevator rope includes a sway function of amplitudes of the sway along a length of the elevator rope over time, comprising:

determining a disturbance of the elevator system based on a state model of the elevator system and a number of measurements of a state of the elevator system, wherein the number of measurements equals a number of unknown coefficients in the model of the disturbance;

determining the sway of the elevator rope based on the disturbance and a system model of the elevator system, wherein the state model relates the unknown coefficients of the disturbance to the amplitudes of the sway, and wherein the system model relates an amplitude of the disturbance to the amplitude of the sway; and controlling the operation of the elevator system based on the sway, wherein steps of the method are performed by a processor.

12. The method of claim 11, further comprising:

determining the number of measurements with a number of sensors, wherein the number of sensors is less than the number of measurements; and adjusting the sway based on a difference between the measurement and estimated sway at a time instance and a location of the measurement.

13. An elevator system, comprising:

an elevator car;

an elevator rope attached to the elevator car;

a set of sensors arranged for determining at a set of measurements of a state of the elevator system;

a sway measurement unit for determining a sway of the elevator rope based on the set of measurements, wherein the sway measurement unit comprises:

a memory for storing a state model of the elevator system and a system model of the elevator system, wherein the state model relates coefficients of disturbance of the elevator system to the set of measurements, and wherein the system model relates an amplitude of the disturbance to the amplitude of sway of the elevator rope; and a processor for determining the disturbance of the elevator system based on the state model and the set of measurements, and for determining the sway of the elevator rope based on the disturbance and the system model; and a motor for operating the elevator rope subject to the sway.

14. The system of claim 13, wherein the processor further adjusts the sway based on a difference between the measurement and estimated sway at a time instance and a location of the measurement.

15. The system of claim 13, wherein the set of sensors includes a set of sway sensors for measuring sways of the rope at a set of sway locations.

16. The system of claim 15, wherein at least one sway sensor provides multiple measurements determined in different instants of time to form the set of measurements of the state of the elevator system.

* * * * *